US008584766B2

(12) United States Patent
Pelletier et al.

(10) Patent No.: US 8,584,766 B2
(45) Date of Patent: Nov. 19, 2013

(54) SEAL ASSEMBLY FOR SEALINGLY ENGAGING A PACKER

(75) Inventors: Daniel Pelletier, Falther (CA); Gilles Dessoulavy, Grossaz/Feigeres (FR); Nabil Ben Mohamed Batita, Gabes (TN)

(73) Assignee: Schlumberger Technology Corporation, Sugar Land, TX (US)

( * ) Notice: Subject to any disclaimer, the term of this patent is extended or adjusted under 35 U.S.C. 154(b) by 1986 days.

(21) Appl. No.: 11/380,524

(22) Filed: Apr. 27, 2006

(65) Prior Publication Data

US 2007/0062710 A1 Mar. 22, 2007

Related U.S. Application Data

(60) Provisional application No. 60/719,488, filed on Sep. 21, 2005, provisional application No. 60/596,614, filed on Oct. 6, 2005.

(51) Int. Cl.
*E21B 33/12* (2006.01)

(52) U.S. Cl.
USPC ..... 166/387; 166/179

(58) Field of Classification Search
USPC ..... 166/54.1, 387, 65.1, 179
See application file for complete search history.

(56) References Cited

U.S. PATENT DOCUMENTS

| | | | | |
|---|---|---|---|---|
| 4,726,425 | A * | 2/1988 | Smith, Jr. | 166/387 |
| 5,332,039 | A | 7/1994 | Primeaux et al. | |
| 5,857,521 | A * | 1/1999 | Ross et al. | 166/296 |
| 5,875,852 | A * | 3/1999 | Floyd et al. | 166/387 |
| 6,719,064 | B2 * | 4/2004 | Price-Smith et al. | 166/387 |
| 6,789,623 | B2 | 9/2004 | Hill et al. | |
| 6,983,796 | B2 | 1/2006 | Bayne et al. | |
| 7,322,422 | B2 * | 1/2008 | Patel | 166/387 |

FOREIGN PATENT DOCUMENTS

| | | |
|---|---|---|
| EP | 210028 | 12/1990 |

* cited by examiner

*Primary Examiner* — Brad Harcourt
(74) *Attorney, Agent, or Firm* — David Groesbeck; Brandon S. Clark

(57) ABSTRACT

A seal assembly sealingly engages a packer that is retrievable from the packer. The seal assembly comprises a sealing structure for receiving by a seal bore of the packer, and a housing assembly defining an inner chamber and having at least one control line conduit and at least one flow conduit passage. The seal assembly further comprises at least one control line extending through the control line conduit into the inner chamber, and at least one flow conduit extending through the flow conduit passage into the inner chamber.

26 Claims, 4 Drawing Sheets

SEAL ASSEMBLY FOR SEALINGLY ENGAGING A PACKER

CROSS-REFERENCE TO RELATED APPLICATIONS

This claims the benefit under 35 U.S.C. §119(e) of U.S. Provisional Application Ser. No. 60/719,488, entitled "Gravel Pack Production Seal Assembly," filed Sep. 21, 2005; and of U.S. Ser. No. 60/596,614, entitled "Gravel Pack Production Seal Assembly," filed Oct. 6, 2005, both hereby incorporated by reference.

TECHNICAL FIELD

The invention relates generally to a seal assembly for sealingly engaging a packer in a wellbore.

BACKGROUND

A wellbore often includes multiple zones (corresponding to different sections of a reservoir or to multiple reservoirs) from which hydrocarbons can be produced. The multiple zones are isolated from each other, usually by the use of one or more packers.

A conventional type of packer that has been used in a multi-zone wellbore is a dual packer that has one or more production strings extending through the packer. A typical dual packer is relatively complex, and manufacture and assembly of the dual packer is often time consuming. As a result, costs associated with using conventional dual packers can be relatively high. Moreover, if conduits for hydraulic lines and electrical lines are provided through the dual packer, then the maximum differential pressure that the dual packer can withstand is lowered. If a differential pressure applied against the packer exceeds this maximum differential pressure, then the dual packer may unset unexpectedly, which is a failure condition.

SUMMARY

In general, an apparatus for use in a wellbore comprises a seal assembly for sealingly engaging a packer, where the seal assembly has a sealing structure for receiving by a seal bore of the packer, and a housing assembly defining an inner chamber and having at least one control line port and at least one flow conduit passage. The seal assembly has at least one control line extending through the control line port into the inner chamber, and at least one flow conduit extending through the flow conduit passage into the inner chamber.

Other or alternative features will become apparent from the following description, from the drawings, and from the claims.

DETAILED DESCRIPTION

In the following description, numerous details are set forth to provide an understanding of the present invention. However, it will be understood by those skilled in the art that the present invention may be practiced without these details and that numerous variations or modifications from the described embodiments are possible.

As used here, the terms "up" and "down"; "upper" and "lower"; "upwardly" and "downwardly"; "upstream" and "downstream"; "above" and "below" and other like terms indicating relative positions above or below a given point or element are used in this description to more clearly described some embodiments of the invention. However, when applied to equipment and methods for use in wells that are deviated or horizontal, such terms may refer to a left to right, right to left, or other relationship as appropriate.

Figure 1:
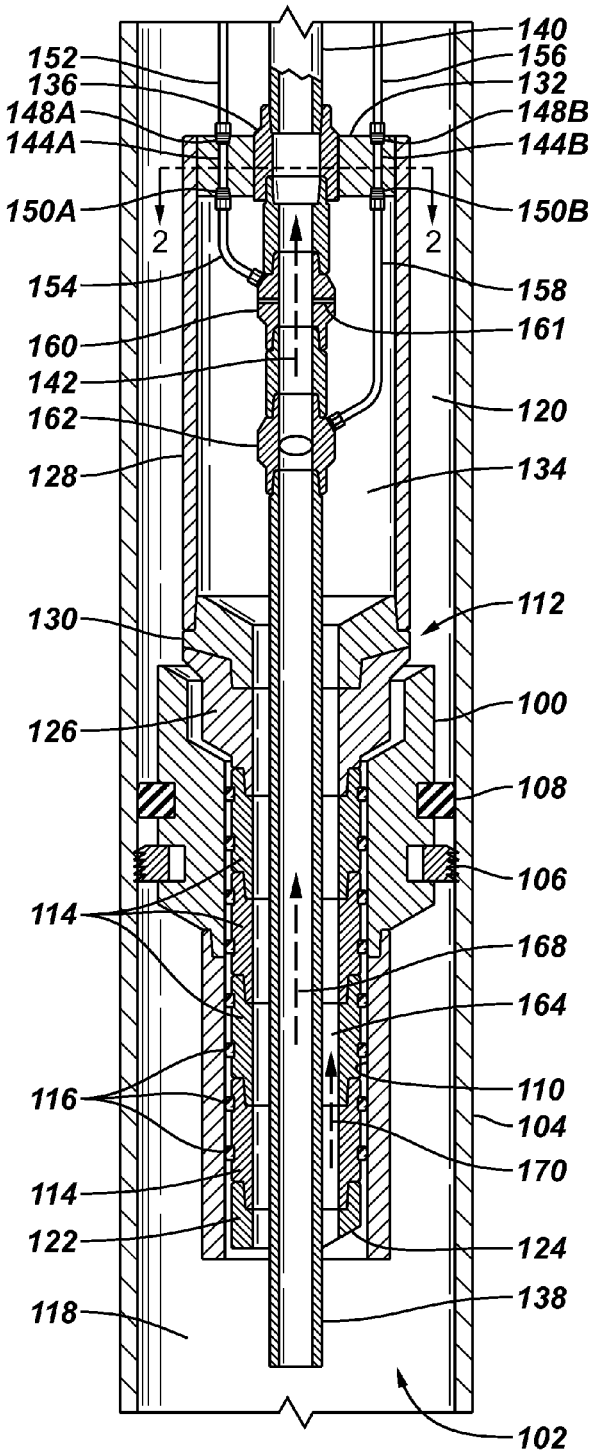
FIG. 1 is a side sectional view of a production string that includes a packer and a seal assembly sealingly received in a seal bore of the packer, in accordance with an embodiment.

FIG. 1 shows a portion of a string including a packer 100 that has been set in a wellbore 102, where the wellbore 102 is lined with a casing or liner 104. As used here, the terms "casing" and "liner" are used interchangeably. In an alternative implementation, the wellbore 102 is an open bore that is unlined or uncased.

The packer 100 has anchoring slips 106 that are capable of extending radially outwardly to engage the inner surface of the casing 104 to anchor the packer 100 with respect to the casing 104. The packer 100 also includes a packing seal 108 expandable to sealingly engaging against the inner surface of the casing 104.

Also, the packer 100 has an inner seal bore 110 for receiving a seal assembly 112. The seal assembly 112 has a sealing structure 114 (such as in the form of a tube) on which external seals 116 are arranged. In the implementation depicted in FIG. 1, eight external seals 116 are arranged along the length of the seal tube 114. In alternative implementations, different numbers of external seals 116 can be used. The seal tube 114 is received in the seal bore 110 of the packer 100. When the seal tube 114 is inserted into the seal bore 110 of the packer 100, the external seals 116 sealingly engage the inner surface of the seal bore 110.

Once the packer seal 108 of the packer 100 is set (expanded radially outwardly) to seal against the inner surface of the casing 104, and the seal tube 114 of the seal assembly 112 is fully inserted into the packer seal bore 110, then the combination of the packer 100 and the seal assembly 112 will cause effective fluid isolation between a lower interval 118 (below the packer/seal assembly) and an upper interval 120 (above the packer/seal assembly) of the wellbore 102.

As depicted in FIG. 1, the seal tube 114 is made up of several discrete pieces that are attached together to form a tubular structure. Alternatively, the seal tube 114 can be a single integral structure. Attached to the lower part of the seal tube 114 is a self-aligning guide shoe 122 having a slanted surface 124 to allow alignment of the seal assembly 112 with respect to the packer 100. The guide shoe 122 is adapted to engage a corresponding guide profile (not shown) of the packer 100 such that engagement of the slanted portion 124 of the guide shoe 122 with the guide profile of the packer 100 allows alignment of the seal assembly with respect to the packer 100.

The upper part of the seal tube 114 is connected to a no-go locator 126, which is used to provide an indication at the earth surface (from which the wellbore 102 extends) that the seal assembly 112 has been correctly positioned in the packer 100. The no-go locator 126 is connected to a housing 128 of the seal assembly 112 by a housing adapter 130. The housing 128 can be made up of a single piece or multiple pieces. The term "housing" refers to one or more housing pieces that are connected together to form an overall housing. The upper end of the housing 128 is connected to a top cap 132. The housing 128 and the top cap 132 form a housing assembly. The housing assembly, made up of the housing 128 and the top cap 132, defines a sealed inner chamber 134. The term "housing assembly" refers generally to any combination of components of the seal assembly 112 that define some inner chamber of the seal assembly 112 in which other components can be positioned.

The top cap 132 has a tubing connector 136 for connecting to a lower tubing 138 (also referred to as a "dip tube") below the top cap 132, and an upper tubing 140 above the top cap 132. The lower tubing 138 extends below the packer 100 to another downhole assembly, such as another packer assembly (not shown). The upper tubing 140 can connect to an upper assembly (e.g., gravel pack assembly, flow control assembly) or even extend all the way to wellhead equipment. A flow path 142 extends through the tubings 138, 140, and the tubing connector 136. More generally, the combination of the upper tubing 140, lower tubing 138, and tubing connector 136 forms a first flow conduit that extends through the top cap 132. The tubing connector 136 can also be considered a form of "flow conduit passage" to allow a flow conduit to extend through the top cap 132. In a different implementation, instead of using the tubing connector 136, a bore can be provided in the top cap 132 through which a tubing can extend, where the tubing can sealingly engage the inner surface of the bore through the top cap 132.

In accordance with some embodiments, the top cap 132 also includes control line passages 144A, 144B, where each control line passage is a ported passage. A ported passage allows a control line to be connected to both sides of the passage. For example, in FIG. 1, the control line passage 144A has a first port 148A to connect to a first control line 152 (above the top cap 132), and a second port 150A to connect to a second control line 154 (below the top cap 132). The control lines 152 and 154 can communicate through the control line passage 144A. Similarly, the control line passage 144B has a first port 148B to connect to a first (upper) control line 156, and a second port 150B to connect to another (lower) control line 158.

More generally, the combination of the control lines 152 and 154 can be considered a "control line" that extends through the top cap 132 through control line passage 144A. Similarly, the combination of the control lines 156 and 158 can be considered a "control line" that extends through the top cap 132 through the control line passage 144B. The term "control line" refers to any of various types of control lines, such as a hydraulic control line, an electrical cable, or a fiber optic cable. A control line is used to communicate with or control one or more components hydraulically, electrically, and/or optically. The one or more components include components in the seal assembly 112, in the packer 100, or at some other location below the top part of the seal assembly 112.

The lower tubing 138 is connected to two valves 160 and 162. In the example of FIG. 1, the valve 160 is a sleeve valve, whereas the valve 162 is a ball valve. Other valves can be used in other implementations. The control line made up of lines 152, 154 controls operation of the valve 160, whereas the control line made up of lines 156, 158 controls the valve 162. The valves 160 and 162 are used to selectively control flow from corresponding different zones of the wellbore. In the example of FIG. 1, the wellbore 102 has two zones. Fluid flow from the two zones is selectively controlled by the valves 160 and 162.

Although described in the context of producing fluids (e.g., hydrocarbons such as oil or gas) from multiple zones, it is noted that embodiments of the invention can also be used for injecting fluids into respective zones.

To communicate with the two zones of the wellbore 102, two flow paths 168, 170 are defined, where the first flow path 168 includes the inner bore of the lower tubing 138. The second flow path 170 includes the annular region outside the lower tubing 138, and includes the annulus region 164 between the lower tubing 138 and the inner surface of the seal tube 114. The second flow path 170 also includes the casing annulus region outside the lower tubing 138 in the lower interval 118 of the wellbore 102.

If the valve 162 is in the open position, and the valve 160 is closed, then the first flow path is open to allow fluid to flow from a first zone through the valve 162 to the fluid path 142 above the valve 162. If the valve 160 is open, and the valve 162 is closed, then the second fluid path is open to allow fluid to flow from the second zone into the inner chamber 134 of the housing assembly and into the inner bore of the lower tubing 138 through port(s) 161. If both valves 160, 162 are open, then fluid flows from the two zones are commingled in the fluid path 142.

Figure 2:
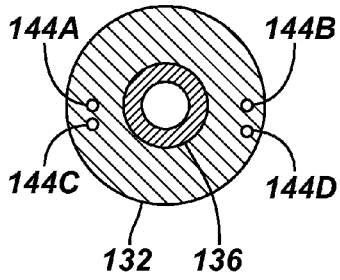
FIG. 2 is a cross-sectional view of a top cap of the seal assembly of FIG. 1, according to an embodiment.

FIG. 2 shows a cross-section of the top cap 132 (taken along section 2-2 in FIG. 1), including the tubing connector 136 and control line passages 144A, 144B. Note that FIG. 2 depicts additional control line passages 144C, 144D to pass additional control lines through the top cap 132. The number of control line passages is implementation specific, as any number of passages (one or above) can be used in various implementations.

In the example of FIG. 1, the control lines extending through the top cap 132 of the seal assembly 112 are used to control respective valves 160, 162. Alternatively, the control lines are coupled to other types of instruments, which can be provided in the inner chamber 134 (or elsewhere in the floating seal assembly 112 or even below the packer 100). The instruments can include sensors, such as pressure, temperature, flow rate, or other types of sensors. These sensors can communicate with the control lines (such as electrical cables or fiber optic cables, for example) to communicate with earth surface equipment. The instruments can also be control devices.

It is noted that the arrangement depicted in FIG. 1 is provided for purposes of example, as other arrangements can include additional, less, or substitute components.

In operation, the components of the seal assembly 112 (including the seal tube 114, no-go locator 126, housing adapter 130, housing 128, top cap 132, lower tubing 138, upper tubing 140, control lines 152, 154, 156, 158) are assembled at an earth surface location (such as at a tool shop or even at the wellsite) prior to deployment of the seal assembly into the wellbore 102. The seal assembly 112 is relatively simple to assemble, particularly when compared to conventional dual packer completions. Thus, according to some embodiments, the seal assembly 112 can be made up at a reduced cost versus conventional dual packer completions.

The packer 100 is first run into the wellbore 102 by a setting tool to the desired depth and set (anchor slips 106 and packing seal 108 set against the casing 102). Once the packer 100 is set, the setting tool can be removed from the wellbore, after which the seal assembly 112 can be lowered into the wellbore. The seal assembly 112 is lowered and sealingly engaged in the packer 100. Note that the sealing engagement between the seal assembly 112 and the packer 100 is a floating sealing engagement (the seal assembly 112 is not anchored or otherwise attached to the packer 100). In this embodiment, the seal assembly 112 is a floating seal assembly.

After sealing engagement of the seal assembly 112 with the packer 100, fluid isolation has been accomplished in which the upper interval 120 and the lower interval 118 of the wellbore 102 have been isolated from each other. At this point, selective actuation of the valves 160 and 162 can be performed to control flow from respective zones in the wellbore 102. Also, prior to, during, or after actuation of the valves 160, 162, sensors located below the top cap 132 (such as in the chamber 134 or even lower down in the wellbore below the packer 100) can be activated, with measurements taken by the sensors communicated through respective control lines that extend through the top cap 132 to earth surface equipment to report various conditions in the wellbore, including temperature, pressure, fluid flow rates, and so forth.

Figure 3:
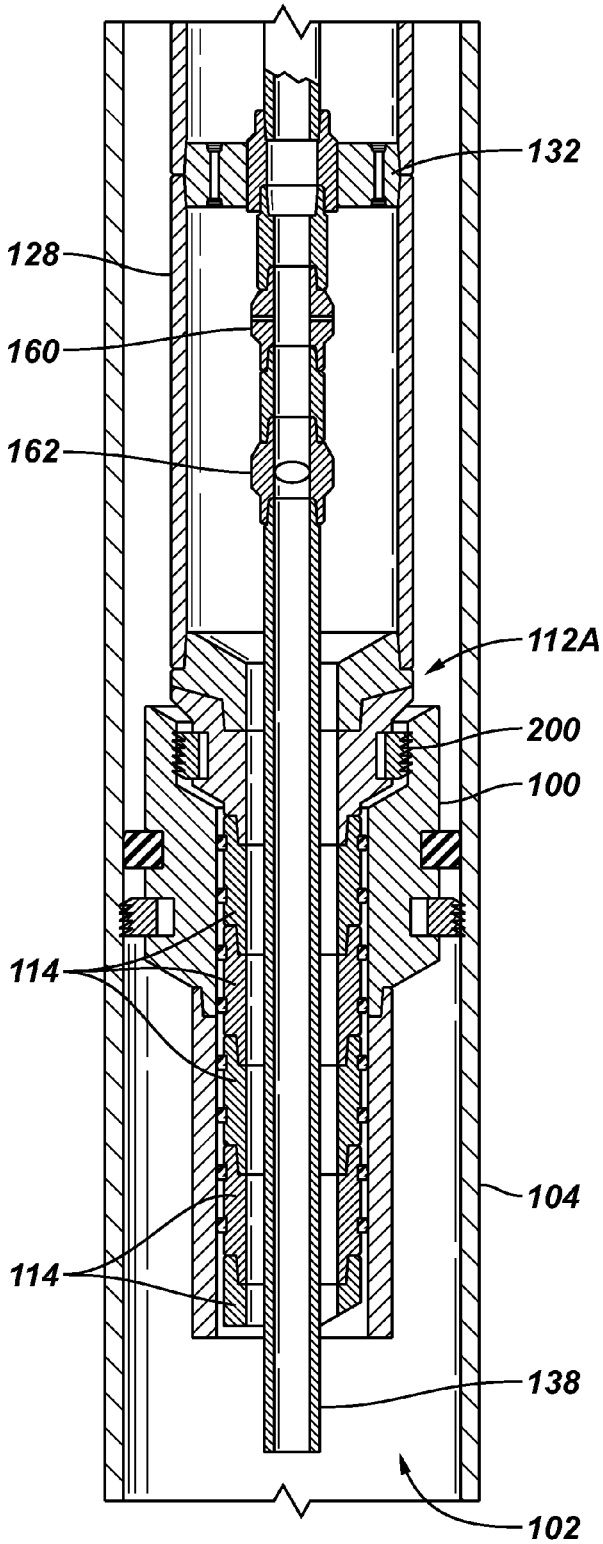
FIG. 3 is a side sectional view of a production string that includes a seal assembly according to another embodiment that is received in a packer.

FIG. 3 shows an alternative embodiment of a string that includes the packer 100 and a seal assembly 112A that is similar to the seal assembly 112 of FIG. 1, except that an anchoring mechanism 200 is provided on the seal assembly 112A for anchoring the seal assembly 112A to an inner surface of the packer 100. The anchoring mechanism 200 (which can be a snap latch, engagement slip, and so forth) allows for the seal assembly 112A to be anchored with respect to the packer 100. In contrast, the seal assembly 112 of FIG. 1 is floating with respect to the packer 100. The remaining components of the seal assembly 112A of FIG. 3 are the same as respective components of the seal assembly 112 of FIG. 1 (and thus are assigned the same reference numerals). Once the anchoring mechanism 200 is set to anchor the seal assembly 112A to the packer 100, the seal assembly 112A can be disengaged from the packer 100 by applying a pull force of greater than a predetermined amount.

Figure 4:
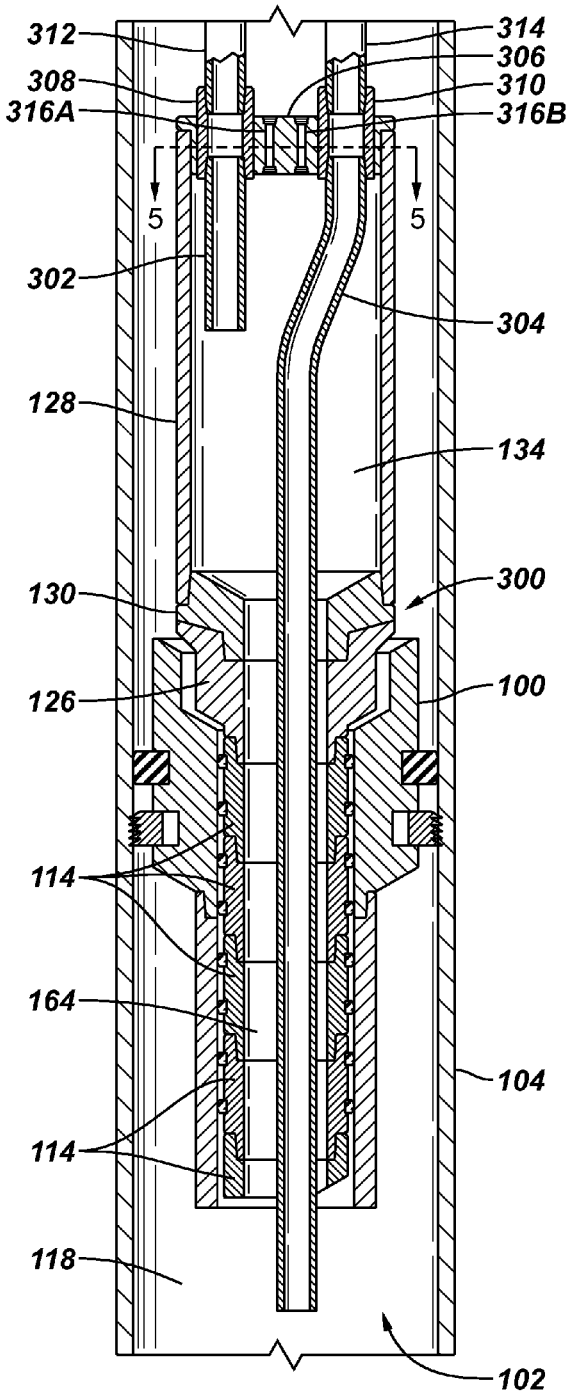
FIG. 4 is a side view of a production string that includes a seal assembly according to a further embodiment that is received in a packer.

FIG. 4 illustrates another embodiment of a seal assembly 300 that is sealingly engageable in the packer 100. The components of the seal assembly 300 that are similar to the corresponding components of the seal assembly 112 of FIG. 1 share the same reference numerals. The seal assembly 300 has two flow conduits (rather than just one flow conduit in the embodiment of FIG. 1) extended through the top part (top cap 306) of the seal assembly 300. The top cap 306 has two tubing connectors 308 and 310 for connection to respective lower tubings 302, 304 below the top cap 306. Similarly, the tubing connectors 308 and 310 can connect to respective upper tubings 312 and 314 above the top cap 306.

The tubings 314 and 304 in combination with the tubing connector 310 form a first flow conduit (that extends through the top cap 306) for communication with a first zone of the wellbore 102. The tubings 312 and 302 in combination with the tubing connector 308 form a second flow conduit in communication with a second zone through the inner chamber 134, annulus region 164, and lower interval 118 of the wellbore 102. The lower end of the tubing 302 is open to allow fluid to flow from the inner chamber 134 of the housing 128 into the inner bore of the tubing 302.

Figure 5:
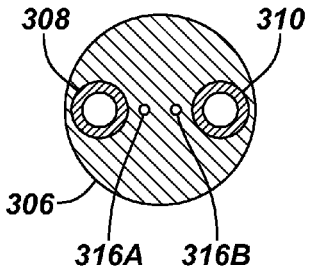
FIG. 5 is a cross-sectional view of a top cap in the seal assembly of FIG. 4.

The top cap 306 also has ported control line passages 316A, 316B to enable control lines (not shown) to extend through the top cap 306. A cross-section of the top cap 306 is depicted in FIG. 5 (taken along section 5-5 in FIG. 4), which shows locations of the tubing connectors 308 and 310 and the control line passages 316A, 316B.

Figure 6:
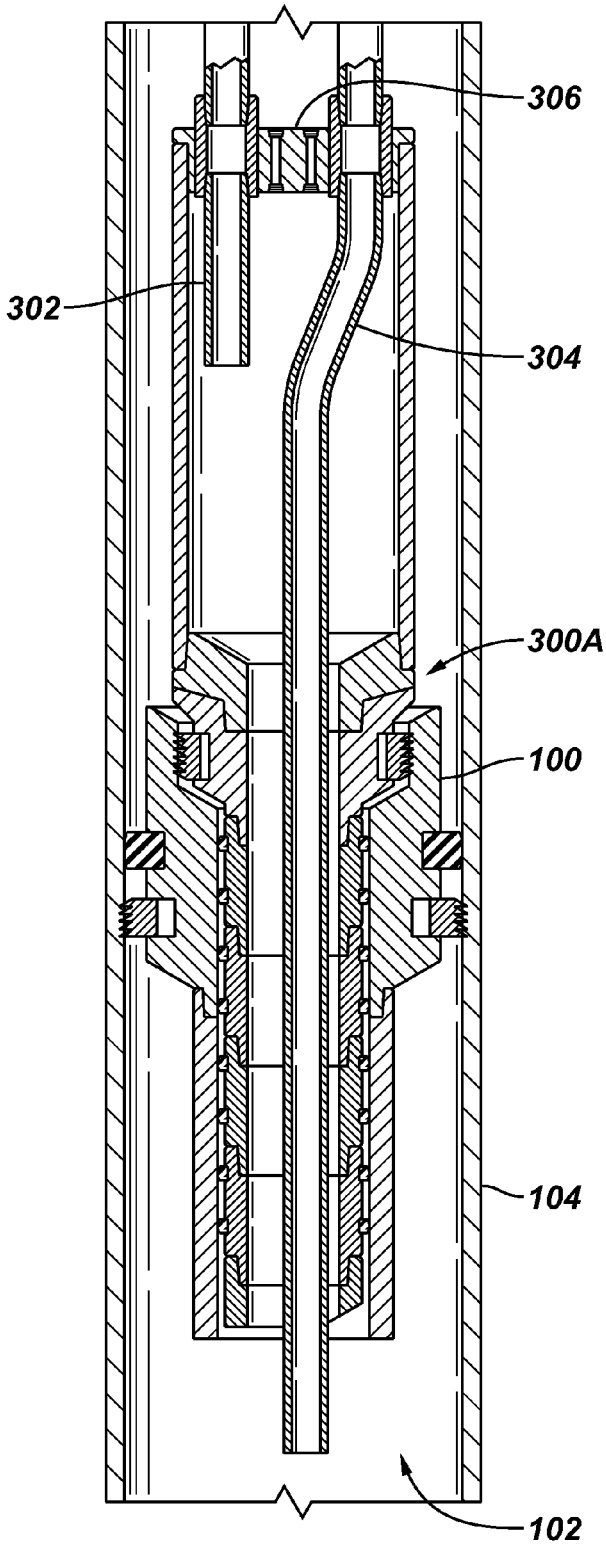
FIG. 6 is a side view of a production string including a seal assembly according to yet a further embodiment received in a packer.

FIG. 6 shows yet another embodiment of a seal assembly 300A, which is the same as the seal assembly 300, except that an anchoring mechanism 400 is provided in the FIG. 6 embodiment to anchor the seal assembly 300A to the inner surface of the packer 100.

The strings of FIGS. 1-6, can be used in various possible well applications, as examples: (1) dual oil producer (produce oil from two zones of the well); (2) dual gas producer (produce gas from two zones of the well); (3) dual fluid injector (inject a fluid such as water into two zones); and (4) dual well with one injector and one producer (produce oil or gas from one zone and inject fluid into another zone).

Also, although the various depicted embodiments are part of dual completions for two zones of a well, it is noted that other embodiments can be employed for more than two zones in a well.

Various benefits are provided by some embodiments, some of which are discussed below. Use of the seal assembly depicted according to some embodiments (such as those depicted in FIGS. 1-6) allows elimination of conventional dual production packers that are relatively complex and expensive. Also, the seal assembly can be flexibly designed to be either a floating seal assembly (floating with respect to the packer), or an anchored seal assembly (anchored to the packer). The seal assembly is relatively cost-effective to manufacture and assemble. The seal assembly is retrievable without having to remove the packer, which simplifies well intervention operations (operations in which a tool is provided downhole to perform some operation, such as repairs and so forth). Also, the seal assembly is ported to allow for electrical, optical, or hydraulic connection with components below the top part of the seal assembly.

The seal assembly according to some embodiments is also less sensitive to high differential pressures than conventional dual packers. For example, in conventional dual packers, application of excessive differential pressure (above some maximum pressure rating of the packer) may cause the packer to unset, which results in a failure condition. The seal assembly according to some embodiments can tolerate higher differential pressures.

While the invention has been disclosed with respect to a limited number of embodiments, those skilled in the art, having the benefit of this disclosure, will appreciate numerous modifications and variations therefrom. It is intended that the appended claims cover such modifications and variations as fall within the true spirit and scope of the invention.

What is claimed is:

1. An apparatus for use in a wellbore, comprising:

a first packer settable in the wellbore;

a seal assembly for sealingly engaging the first packer, the seal assembly retrievable from the first packer, the seal assembly comprising:

a sealing structure for receiving by a seal bore of the first packer;

a housing assembly defining an inner chamber and having at least one control line passage and at least one flow conduit passage;

at least one control line extending through the control line passage into the inner chamber; and at least one flow conduit extending through the flow conduit passage into the inner chamber, wherein the seal assembly including the at least one control line passage enables deployment of the at least one control line without provision of a second packer having a passage for the at least one control line to isolate a well annulus region from the inner chamber, and wherein the first packer also is without a passage for the at least one control line.

2. The apparatus of claim 1, wherein the housing assembly has a housing and a cap attached to an upper end of the housing, the cap having the control line passage and the flow conduit passage.

3. The apparatus of claim 1, wherein the seal assembly defines at least two flow paths, one of the at least two flow paths comprising an inner bore of the flow conduit.

4. The apparatus of claim 3, wherein a second of the at least two flow paths comprises an annular region outside the flow conduit, the annular region including a part of the inner chamber.

5. The apparatus of claim 4, wherein the seal assembly has a first valve positioned in the inner chamber, the first valve controllable by the control line to control axial flow of fluid through an inner bore of the flow conduit, and wherein the seal assembly further comprises a second valve to control radial flow of fluid between the inner chamber and the inner bore of the flow conduit.

6. The apparatus of claim 5, wherein the housing assembly further comprises a second control line passage, and wherein the seal assembly further comprises a second control line extending through the second control line passage into the inner chamber, the second control line to control the second valve.

7. The apparatus of claim 6, wherein the seal assembly is assembled at an earth surface prior to deployment into the wellbore.

8. The apparatus of claim 7, wherein the seal assembly sealingly engages the first packer that has been set in the wellbore prior to deployment of the seal assembly into the wellbore.

9. The apparatus of claim 5, wherein the first valve when closed blocks axial fluid flow from a first portion of the inner bore of the flow conduit to a second portion of the inner bore.

10. The apparatus of claim 3, wherein the housing assembly has a second flow conduit passage, the seal assembly further comprising a second flow conduit extending through the second flow conduit passage into the inner chamber, wherein a second of the at least two flow paths comprises an inner bore of the second flow conduit.

11. The apparatus of claim 1, further comprising an instrument positioned in the inner chamber and connected to the control line, wherein the control line comprises at least one of a hydraulic line, electrical line, and fiber optic cable.

12. The apparatus of claim 11, wherein the instrument is controllable by the control line.

13. The apparatus of claim 1, wherein sealing engagement between the seal assembly and the seal bore of the packer is a floating sealing engagement.

14. The apparatus of claim 1, wherein the seal assembly further comprises an anchoring mechanism to anchor the seal assembly to the first packer.

15. The apparatus of claim 1, wherein the control line comprises one of a hydraulic control line, electrical cable, and fiber optic cable.

16. The apparatus of claim 15, wherein the flow conduit is used to perform either production of hydrocarbons or injection of fluids.

17. The apparatus of claim 1, wherein the housing assembly comprises an upper cap having a tubing connector, and the flow conduit comprising an upper tubing and a lower tubing connected to the tubing connector.

18. A method for use in a well having plural zones, comprising:

lowering a first packer into the well and setting the first packer;

after setting the first packer, running a seal assembly into the well, the seal assembly having a sealing structure sealingly engageable in a seal bore of the packer, the seal assembly further comprising a housing assembly defining a sealed inner chamber, a control line extending through a control line passage of the housing assembly into the inner chamber, and a flow conduit extending through a flow conduit passage of the housing assembly into the inner chamber, wherein the seal assembly including the control line passage enables deployment of the control line without provision of a second packer having a passage for the control line to isolate a well annulus region from the sealed inner chamber, and wherein the first packer also is without a passage for the control line; and communicating fluids with the plural zones through the seal assembly.

19. The method of claim 18, further comprising providing a floating sealing engagement between the seal assembly and the first packer.

20. The method of claim 18, further comprising engaging an anchoring mechanism of the seal assembly with the first packer.

21. The method of claim 18, wherein an instrument is provided below a combination of the seal assembly and packer, the method further comprising communicating with the instrument with the control line.

22. The method of claim 18, wherein an instrument is provided in the sealed inner chamber, the method further comprising communicating with the instrument with the control line.

23. The method of claim 18, wherein the seal assembly defines at least two fluid passages to communicate with the plural zones, and wherein the seal assembly has a first valve to control axial fluid flow through an inner bore of the flow conduit, and a second valve to control radial flow from the sealed inner chamber to the inner bore of the flow conduit.

24. A system for use in a wellbore, comprising:

a first packer settable in the wellbore; and a seal assembly for deployment into the wellbore after setting of the first packer, the seal assembly to sealingly engage the first packer, the seal assembly comprising:

a sealing structure for receiving by a seal bore of the first packer;

a housing assembly defining an inner chamber and having an upper portion and having at least one control line passage and at least one flow conduit passage passing through the upper portion;

at least one control line extending through the control line passage; and at least one flow conduit extending through the flow conduit passage, wherein the seal assembly including the at least one control line passage enables deployment of the at least one control line without provision of a second packer having a passage for the at least one control line to isolate a well annulus region from the inner chamber, and wherein the first packer also is without a passage for the at least one control line.

25. The system of claim 24, wherein the upper portion of the housing assembly comprises a cap having the control line passage and the flow conduit passage.

26. The system of claim 24, wherein the seal assembly has at least one valve, the at least one valve controllable by the control line.

* * * * *